US005921772A

United States Patent [19]

Hopson et al.

[11] Patent Number: 5,921,772

[45] Date of Patent: Jul. 13, 1999

[54] TWO PIECE RIDER ASSEMBLY

[75] Inventors: C. E. Hopson, Birmingham, Ala.; Frank Campbell, Jr., Martinsville, Va.

[73] Assignee: C & H Alloy Skid Riders Company, Birmingham, Ala.

[21] Appl. No.: 09/045,998

[22] Filed: Mar. 23, 1998

[51] Int. Cl.[6] ..... F27D 3/02

[52] U.S. Cl. ..... 432/234; 432/236; 432/246

[58] Field of Search ..... 432/234, 235, 432/236, 246

[56] References Cited

U.S. PATENT DOCUMENTS 4,689,009 8/1987 Heuss ..... 432/235

*Primary Examiner*—Teresa Walberg
*Assistant Examiner*—Jiping Lu
*Attorney, Agent, or Firm*—Kenneth Lee Cleveland

[57] ABSTRACT

The two piece rider assembly consist of a base piece that is welded to the skid pipe of a steel slab reheat furnace and a top piece that is removably attached to the base piece. The base piece has a cut out slot divided into three sections. The center section has strait walls and the front and back sections have walls that slope into the cut out to reduce the cross sectional distance. The cut out is open at the front section. The top piece has two protrusions with dove tail looking cross sections that fit into the front and back sections of the cut out slot of the base piece. The tip of the dove tail protrusion is wider than the neck of the cut out slot in the base piece so that upward movement is prevented when they are engaged. The protrusions are separated by at least the distance of the front section of the cut out slot of the base piece. The top piece is mounted to the base piece by dropping it so that the first protrusion drops into the center section of the cut out slot and the second protrusion drop in front of the open front section. The top piece then slides back with the protrusions preventing sideways and upward movement. A pin is inserted into a cavity created by a groove on each piece to prevent forward movement of the top piece locking it in place. The entire assembly is used in combination with other such assemblies spaced apart no less than necessary to slide the top piece forward and up facilitating easy replacement of the worn top parts.

2 Claims, 5 Drawing Sheets

TWO PIECE RIDER ASSEMBLY

BACKGROUND OF THE INVENTION

The production of thin sheet steel used to produce products such as automobile bodies and household appliances is most often accomplished using a two step process. The first step is to heat the raw slab to a temperature sufficient to produce pyroplasticity in the object. The second phase occurs in the hot rolling mill where a rolling process reduces the thickness of the slab. The slabs are usually heated to rolling temperature (2000° F.–2500° F.) in large reheat furnaces prior to processing. The thin sheet of steel is called "strip" by those skilled in the art. It is the reheat furnace portion of the entire process of steel "strip" production to which the invention relates.

The furnace is generally either of the pusher type or walking beam type. In both types of furnace, a network of water-cooled piping commonly known as a skid system is used to support the slabs during the heating cycle. The skid system is usually water-cooled to an maintain its mechanical strength at furnace temperatures. Each skid is comprised of a horizontal and longitudinally oriented, water-cooled pipe (skid pipe) that is equipped with a steel or high temperature alloy wear bar, rider, or rail affixed (welded) to the top of the skid pipe and insulation completely covering the pipe.

Riders are the part that the slab actually rest on and support the weight of the slabs. If they are degraded by the furnace environment they can cause product defects. Riders are most commonly attached to the upper surface of the water-cooled skid pipe by "partial" penetration welding, "full" penetration welding, and "cleating." For purposes of the present invention these or any other method is acceptable.

Attachment of riders also has a remarkable effect upon the cost of required periodic replacement since the existing designs are inherently difficult to replace without penalties such as severe damage caused to the base skid member when the old rider is removed. Rider replacement also requires that the essential energy saving skid pipe insulation that covers the entire circumference of the skid must be partially removed to allow access to the areas where rider replacement occurs. The described method of rider maintenance is very labor and time intensive and almost always leads to compromise that affects ultimate cost and quality of the end product. Several existing ideas attempt to alleviate this problem.

The Harding Patent, U.S. Pat. No. 5,257,928 discloses a two piece wear bar with a mechanical locking means. A magnetic sphere is used to lock the two pieces together. The drawback to this patent is that the magnet required to move the ball must be so powerful that it seriously disrupts the replacement process and often picks up the entire skid assembly. Another draw back is that the system does not have enough contact with the water cooled skid to properly dissipate the heat.

The Heuss Patent, U.S. Pat. No. 5,136,610 discloses a multi piece assembly also includes a ceramic material used as insulation between rider and the cut out housing fitting. The ceramic insulation is the weakness of this system. The insulation becomes brittle after prolonged exposure to furnace temperatures and fails. Furthermore, the insulation itself prevents heat transfer to the cooling pipe that the housing is connected to which causes the rider to fail early.

The Webster Patent, U.S. Pat. No. 4,601,659 discloses using a hollow upper wear bar cleated to the upper surface of the structural member. The disadvantage of all hollow upper parts it the reduced strength against compression. The combination of weight and heat causes these type of wear bars to compress. This causes unevenness on the surface of the strip. Consequently, when one fails all must be replaced because the new top piece is taller than its neighbors. In fact, the Webster design virtually requires that all of the top pieces in a row be changed as you cannot get to an inside top piece without removing the others on the same row.

SUMMARY OF THE PRESENT INVENTION

The present invention is a superior rider assembly system for reducing the cost of rider replacement by reducing the labor and material required to replace the worn out rider. The need to remove skid pipe insulation to facilitate rider exchange is eliminated and the distance between riders required to remove the individual top parts is substantially less than previous multipiece riders. This design also reduces the need to replace multiple riders when only one has failed. They are placed in combination with similar rider assemblies spaced apart by no less than one third the length of the top piece. Any type of conventional or specially designed skid pipe, regardless of the cross sectional shape, will suffice for support of the invention.

The top piece of the rider assembly, being made of a higher temperature alloy, is engaged in communication with the base piece using interlocking dovetail assemblies to accurately position and "seat" the top piece of the rider assembly, which are then locked in place by a pin. The pin can be held in place by any mechanical means such as a head and cotter pin, a bolt and nut, spot welding, wing nuts on each end, etc. The height of the base piece is such that the top surface is always above the uppermost surface of the skid pipe insulation, allowing for easy replacement of the top piece of the rider assembly without the need for removal of any of the skid insulation. Both the base piece and the top piece are provided with a conforming and aligned groove, preferably cylindrical and tapered, that receives the pin in close communication such that the top wear piece is "locked" to the lower base piece of the assembly. The cylindrical pin is preferably spot welded to the top and base pieces as a means of locking the entire assembly together.

These and other objectives of the invention will become even more apparent when read in light of the specification, drawings, and the claims appended hereto.

BRIEF DESCRIPTION OF THE PREFERRED EMBODIMENT

The preferred embodiment is shown in FIGS. 1 through 5.

Figure 1:
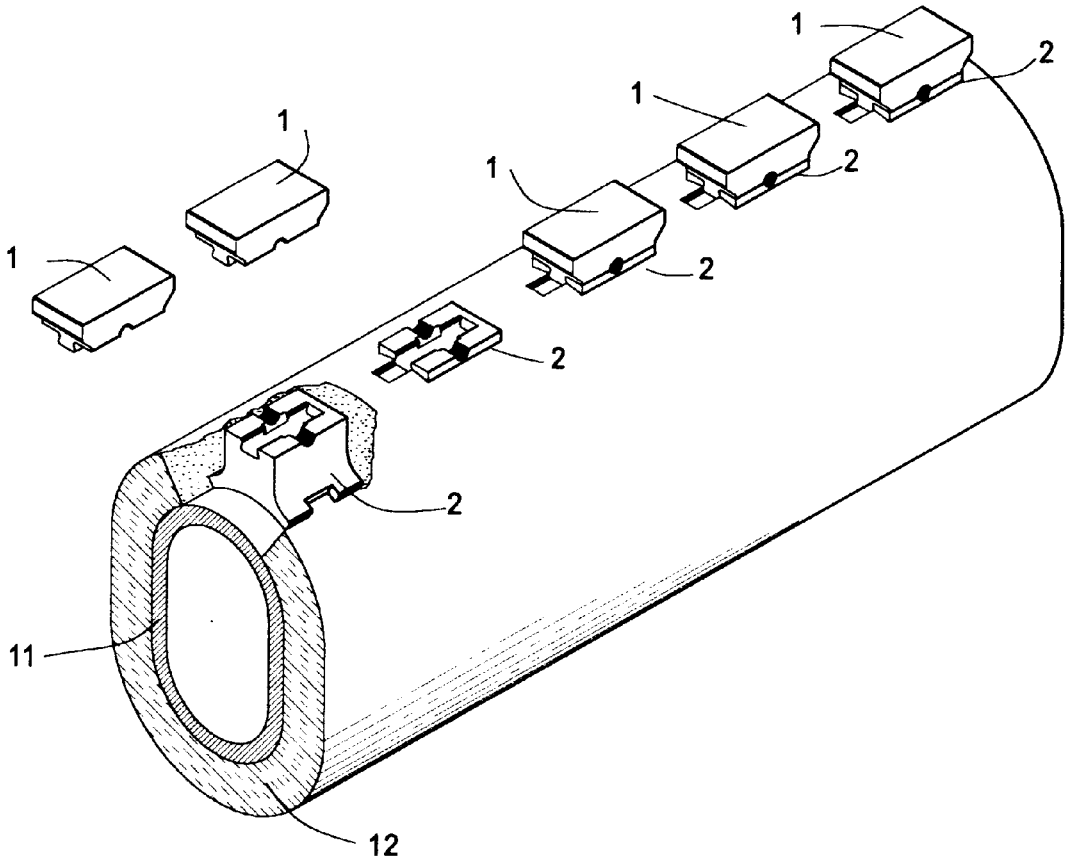
FIG. 1 is an isometric view of a section of a conventional skid pipe in a walking beam furnace showing a segment of the water-cooled pipe and a plurality of secured, intermittent rider assemblies of the preferred embodiment.
Figure 4:
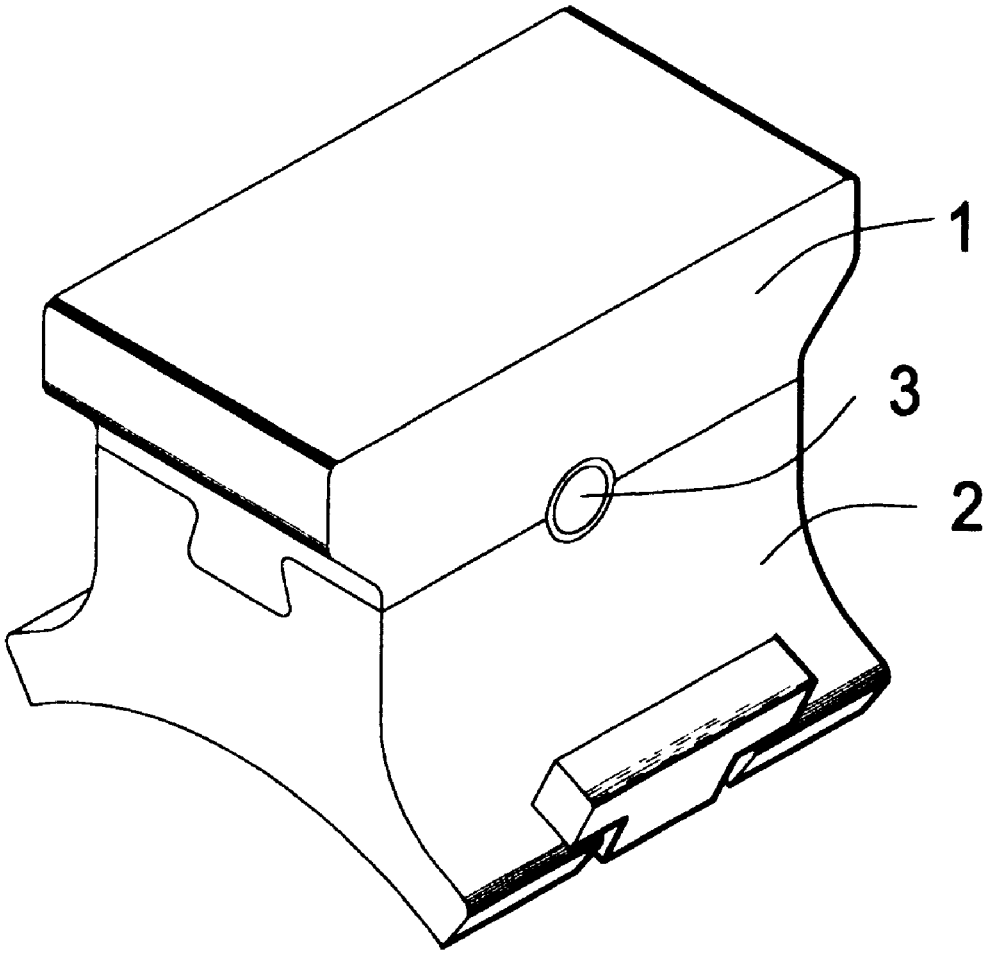
FIG. 4 is an isometric view of the three parts of the rider assembly after engagement of the base piece and the top piece, along with the tapered locking pin and an example of one cleat used for attachment of the rider base to the skid pipe.

As can be seen in FIG. 4, the top piece 1 fits on the base piece 2. Pin 3 holds the top piece in place and is itself spot welded (not shown) in order to hold it in place. As shown in FIG. 1, base piece 2 is attached to a coolant containing skid pipe 11. The insulation 12 completely covers skid pipe 11 but does not interfere with removal of top piece 1 when removal is necessary. Consequently, removal of top piece 1 does not require removal of any of insulation 12 and saves labor, time, and material.

Figure 2:
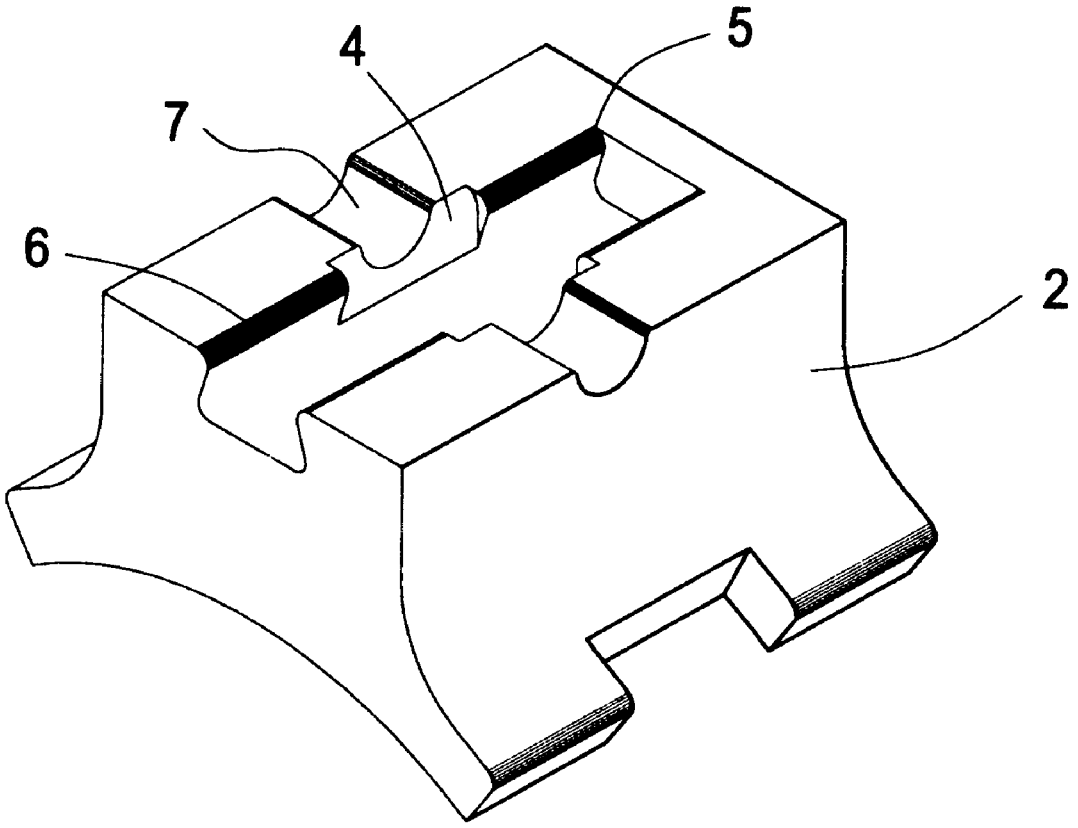
FIG. 2 is an isometric view of the rider base piece of the rider assembly described in the preferred embodiment.
Figure 5:
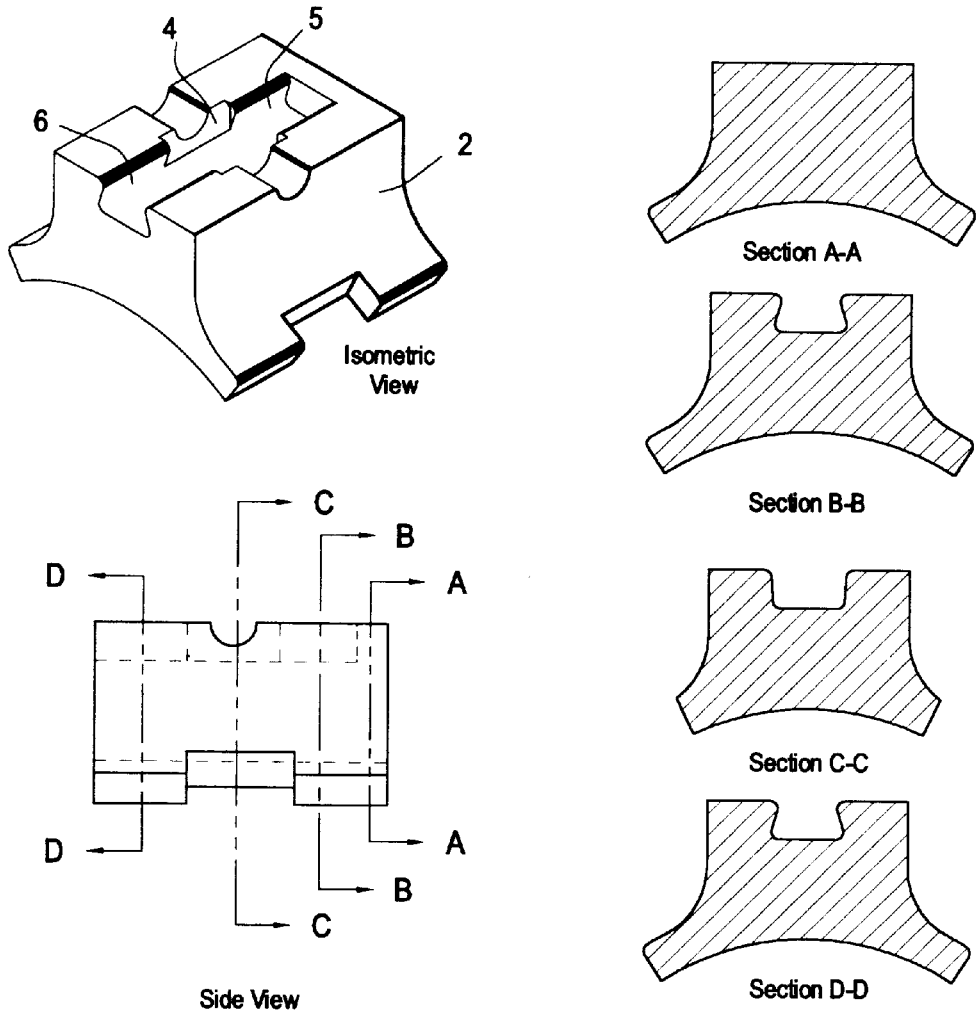
FIG. 5 is a cross section view of the base piece showing the view at 4 different cross sections and has isometric and side views to orient the viewer.

As shown in FIG. 2, base piece 2 is adapted on the bottom to fit on top of a skid pipe and adapted on the top with a cut out slot running most of the length of the base piece 2 and preferably open at the front end and not at the back end and further divided into 3 sections. The bottom of the cut out slot is generally parallel to the top surface of the skid pipe. The center section 4 has walls that are perpendicular to the plane of the bottom of the cut out slot and are vertical with reference to the base piece as attached to a skid pipe. The sections on each end of the cut out slot 5 and 6 have walls that angle into the cut out area so that the cross section of the cut out slot at its top is smaller than its cross section at its bottom in sections 5 and 6. As seen in FIG. 5, the cross section at C shows the walls of center section 4 straight up but the walls at cross section B which correspond to back section 5 lean in and have a dove tail appearance in the cross section. Similarly, the walls at cross section D which corresponds to front section 6 lean in and have the same dove tail appearance.

The length of the center section 4 of the first cut out slot must be at least the length of the back section 5 of the cut out slot. It is preferable for back section 5 and front section 6 to be the same length and for center section 4 to be slightly longer than both; however, it is only essential that the length of center section 4 be at least one third the length of the cut out slot and longer than either protrusion on top piece 1. The base piece 2 is further adapted with a groove preferably perpendicular to the cut out slot intersecting it in center section 4 and running the entire width of the top of the base piece 7.

Figure 3:
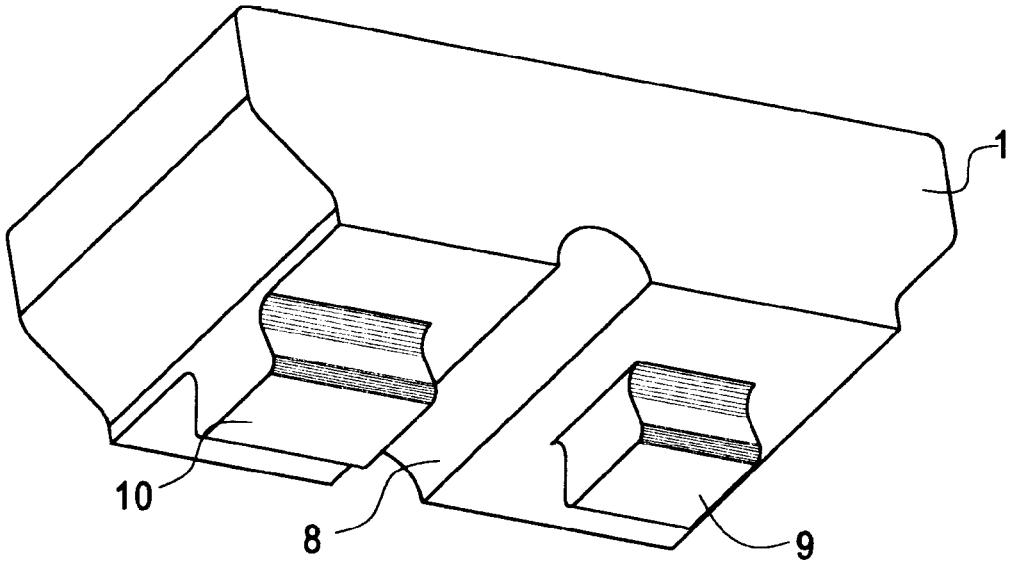
FIG. 3 is an isometric view of the top piece of the rider assembly described in the preferred embodiment.

As shown in FIG. 3, top piece 1 has a generally flat top to receive the strip and is adapted on the bottom with a groove 8 that matches the groove 7 on the base piece when the top and base lower pieces are fitted together. The bottom of the top piece 1 has two protrusions 9 and 10 that fit into the cut out slot in the lower piece 2. This is accomplished by providing each protrusion with a dove tail looking cross sectional area that fits into the space between the walls and bottom of areas 5 and 6 of the base piece. The length of the protrusions 9 and 10 respectively is no greater than the corresponding length of sections 5 and 6 respectively and they are aligned so that both fit into the cut out slot on the base lower piece when fully engaged. The walls of protrusions 9 and 10 are sloped at generally the same angle as the walls of the cut out slot of base piece 1 so that the base of each protrusion has a smaller cross sectional distance than the end of the protrusion. Note that the cross sectional distance of the base of each protrusion 9 and 10 can be no larger than the cross sectional distance of the top of the cut out slot of base piece 1 and the cross sectional distance of the end of the protrusion can be no larger than the cross sectional distance of the bottom of the cut out slot of base piece 1. The length of first protrusion 9 can be at most equal to the length of the center section 4 of the cut out slot of the base piece 1 and the length of second protrusion 10 cannot exceed the length of protrusion 9.

To connect the top piece 1 to the base piece 2, the first protrusion 9 drops into the center section 4 of the cut out slot of the base piece 2 and second protrusion 10 drops outside of the base piece 2. It is only necessary to leave sufficient room between assemblies for this to occur. Since first protrusion 9 fits in the space between the walls of the back section 5 of the cut out slot of the base piece 2 and second protrusion 10 similarly fits in the space between the walls of the front section 6 of the cut slot of the base piece 2, sliding the top piece toward the back of the base piece 2 moves the first protrusion 9 into the space between the walls of the back section 5 and the second protrusion 10 into the space between the walls of front section 6. Because the walls are sloped in sections 5 and 6 and protrusions 9 and 10 have matching sloped walls the pieces cannot be separated without sliding top piece 1 to its original position. This is prevented by a pin 3 of sufficient size to fill in the cavity created when the groove 7 of the base piece 2 and the groove 8 of the top piece 1 match. The pin 3 is spot welded in place. To replace a worn or damaged top piece 1 the spot weld is knocked off, the pin 3 is removed and the top piece 1 slides forward and is lifted out.

The present invention as described, illustrated and claimed, therefore, fully supports and meets the objects of the invention. Although a preferred embodiment has been described and claimed, those skilled in the art understand that numerous modifications, amendments and alterations of the invention, including the structure illustrating the invention, will occur, all of which clearly fall within both the spirit and the scope of the specification, drawings, and the claims herein.

We claim:

1. A two piece rider assembly comprising:

a base piece adapted on the bottom to fit on top of a coolant containing skid pipe further adapted on the top with a cut out slot running lengthwise open at the front end that is divided into three sections the center section of which is not shorter than either the front section or the back section wherein the side walls of said front section slope at an angle into the cut out slot so that the cross sectional distance at the bottom of the cut out slot in the front section is greater than the cross sectional distance at the top of the cut out slot in the front section, the side walls of the center section of the cut out slot do not slope inward hence they are generally perpendicular to the plane of the bottom surface of the cut out slot, the side walls of the back section of the cut out slot slope at an angle into the cut out slot so that the cross sectional distance at the bottom of the cut out slot in the back section is greater than the cross sectional distance at the top of the cut out slot in the back section and the base piece is further adapted with a groove running not parallel to the cut out slot and intersecting the cut out slot;

a top piece with a generally flat top surface adapted to receive a "slab" on top and further adapted on the bottom with a groove that lines up with and matches the groove on the base piece when the top piece and the base piece are fitted together and said top piece is further adapted with a first protrusion aligned to fit in the space between the walls of the back section of the cut out slot of the base piece having side walls sloped at generally the same angle as the side walls of the back section of the cut out slot of the base piece wherein the cross sectional distance of the end of the first protrusion is greater than the cross sectional distance of the beginning of the first protrusion but less than the cross sectional distance of the back section of the cut out slot of the base piece at its bottom but also greater than the cross sectional distance of the back section of the cut out slot of the base piece at its top and the cross sectional distance of the beginning of the first protrusion is less than the cross sectional distance of the top of the back section of the cut out slot of the base piece with the length of the first protrusion of sufficient size to fit into the space between the walls of the back section of the cut out slot of the base piece and the width of the first protrusion is not greater than the length of the center section of the cut out slot of the base piece and the top piece is further adapted with a second protrusion aligned to fit in the space between the walls of the front section of the cut out slot of the base piece having side walls sloped at generally the same angle as the side walls of the front section of the cut out slot of the base piece wherein the cross sectional distance of the end of the second protrusion is greater than the cross sectional distance of the beginning of the second protrusion but less than the cross sectional distance of the front section of the cut out slot of the base piece at its bottom but also greater than the cross sectional distance of the front section of the cut out slot of the base piece at its top and the cross sectional distance of the beginning of the second protrusion is less than the cross sectional distance of the top of the front section of the cut out slot of the base piece with the length of the second protrusion of sufficient size to fit into the space between the walls of the front section of the cut out slot of the base piece and the width of the second protrusion is not greater than the length of the center section of the cut out slot of the base piece and where the distance between protrusions is not less than the length of the center section of the first cut out slot of the base piece; and a pin of sufficient size to fit in the cavity created by the groove of the base piece and the groove of the top piece; and a means for fastening said pin in place.

2. The devise according to claim 1 wherein the corners and edges of the slots and protrusions are rounded and each protrusion has a "dove tail" appearance in a rear cross sectional view and the front and back sections of the slot of the base piece has a matching "dove tail" appearance when viewed from a rear cross sectional view.

* * * * *